US010822154B2

(12) United States Patent
Carter

(10) Patent No.: US 10,822,154 B2
(45) Date of Patent: Nov. 3, 2020

(54) PACKAGING WITH INSULATIVE WALLS HAVING COOLING DEVICE

(71) Applicant: Mark Carter, Heber City, UT (US)

(72) Inventor: Mark Carter, Heber City, UT (US)

( * ) Notice: Subject to any disclaimer, the term of this patent is extended or adjusted under 35 U.S.C. 154(b) by 249 days.

(21) Appl. No.: 15/984,143

(22) Filed: May 18, 2018

(65) Prior Publication Data

US 2019/0352077 A1 Nov. 21, 2019

(51) Int. Cl.
*B65D 81/38* (2006.01)

(52) U.S. Cl.
CPC ..... *B65D 81/3862* (2013.01)

(58) Field of Classification Search
CPC ..... B65D 81/3862; B65D 81/18
USPC ..... 62/453, 440; 220/592.01, 592.03, 592.09
See application file for complete search history.

(56) References Cited

U.S. PATENT DOCUMENTS 4,526,906 A * 7/1985 Wegner ..... C08G 18/381 260/DIG. 24
4,830,912 A * 5/1989 Weiss ..... A01G 5/04 264/45.2
5,897,017 A * 4/1999 Lantz ..... B65D 81/3823 220/592.1
5,924,302 A * 7/1999 Derifield ..... B65D 81/3862 62/371
5,952,053 A * 9/1999 Colby ..... C08G 18/16 427/393
5,971,218 A * 10/1999 Le ..... B67D 3/04 220/324
6,619,500 B1 * 9/2003 Lantz ..... B65D 81/3823 220/592.1
8,993,079 B1 * 3/2015 Duong ..... B65D 81/3897 428/35.3
2003/0217948 A1 * 11/2003 Lantz ..... B65D 5/48038 206/591
2009/0078699 A1 * 3/2009 Mustafa ..... B65D 81/3862 220/1.5

* cited by examiner

*Primary Examiner* — Justin M Jonaitis
(74) *Attorney, Agent, or Firm* — Jeffrey K. Riddle; Riddle IP, PLLC

(57) ABSTRACT

A packaging may include at least one insulative wall and at least one cooling device embedded into the at least one wall. A method of forming at least one insulative wall of a package may include placing a cooling device into a form, closing the form, injecting a liquid form of an expansive foam, and curing the foam.

21 Claims, 7 Drawing Sheets

PACKAGING WITH INSULATIVE WALLS HAVING COOLING DEVICE

BACKGROUND

Package delivery has become a significant part of commerce in today's economy. Today, a vast majority of companies that sell products often have those products available online and shipped to the purchaser. Indeed, in some instances, the product being shipped may be perishable and/or adversely affected to changes in temperature.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
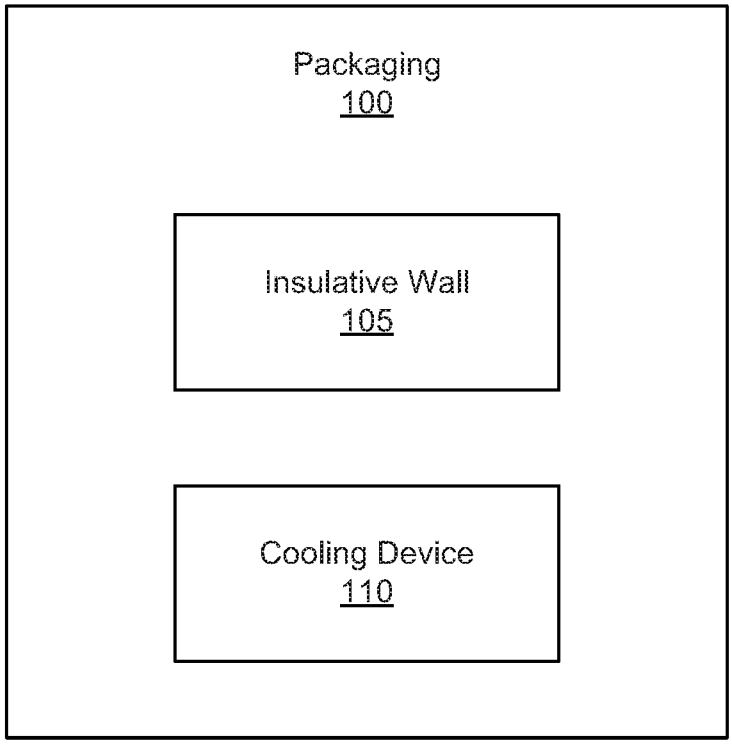
FIG. 1 is a block diagram of a packaging (100) according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Shipping products across a geographical area includes packaging the product such that the product reaches the end consumer in the state that the consumer expects. Any damage to the products resulting from the shipping process may result in poor consumer satisfaction as well as returned product at the cost of the shipper, the consumer, and/or the manufacturer of the product.

To alleviate any potential damage to the product being shipped, the packaging used to ship the product in may be altered to prevent such potential damage. In an example, this may include adding a cooling device such as an ice pack in order to prevent overheating of certain types of products. However, the ice packs may limit the volumetric capacity of the packaging as well as fail to provide adequate cooling over the transit period of the shipped product.

The present specification describes a packaging including at least one insulative wall and at least one cooling device embedded into the at least one wall.

The present specification further describes a method of forming at least one insulative wall of a package that includes placing a cooling device into a form; closing the form; injecting a liquid form of an expansive foam; and curing the foam.

The present specification also describes a shipping container, that includes a box; a plurality of insulating walls, at least one side of each of the insulating walls laid against the surface of at least one wall of the box; and at least one cooling device embedded into at least one of the plurality of insulating walls.

As used in the present specification and in the appended claims, the term "chamfer" is meant to be understood as a transitional edge between two faces of an object.

Turning now to the figures, FIG. 1 is a block diagram of a packaging (100) according to an example of the principles described herein. The packaging (100) may include an insulative wall (105) and a cooling device (110). In an example, the packaging (100) may further include a box to encompass the insulative wall (105).

The insulative wall (105) may be any type of wall that may help to insulate a product from changes in temperature. In an example, the insulative wall (105) may include a plurality of insulative walls (105) that form a cube with an interior portion that is hollow. The interior portion, during use of the packaging (100), provides for an object to be held therein. The object may be any type of object including both products to be shipped and, specifically, products that may be damaged due to changes in temperature had the packaging (100) not be present. By way of example, the product may be a chocolate product that, if subjected to an increase in temperature during transit, may melt damaging the quality and/or taste of the chocolate. By way of another example, the product may be a glass jar full of perishable foodstuffs. In this example, it may be disadvantageous for the glass jar to be subjected to extremely cold temperatures sufficient to freeze the perishable foodstuffs therein and causing the glass jar to break spilling the perishable foodstuffs in the packaging (100). The insulative wall (105), in this example, may therefore prevent the transmission of heat out of the packaging (100) according to thermodynamic principles. It is to be understood in the present specification that, although the principles described herein use a cooling device (110) as a means of maintaining temperature within the packaging (100), the principles described herein extend also to a heating device used in connection with the insulative wall (105).

The insulative wall (105) may be made of any type of insulating material. In an example, the insulative wall (105) may be made of a foam. In an example, the insulative wall (105) may be manufactured using any type of expansion foam that is presented in, for example, a form as a liquid and is allowed to cure thereby creating an insulative wall (105) according to the principles described herein. During the manufacturing process, the cooling device (110) may be incorporated into the insulative wall (105) itself. Continuing with the example manufacturing process described immediately above, the cooling device (110) (or alternatively heating device) may be placed within a certain location with the form before the liquid expansive foam is introduced into the form. As the expansive foam is introduced into the form, the liquid expansive foam forms around the cooling device (110) (or alternatively the heating device) such that the cooling device (110) is embedded into the insulative wall (105) after curing of the liquid expansive foam.

In an example, the liquid expansive foam product may include a mixture of a polyether polyol resin and a polymeric isocyanate. In this example, any type of polyether polyol resin and polymeric isocyanate may be used based on a number of criteria. These criteria include the length of time that the packaging (100) is to be subjected to increases and/or decreases in temperatures during transit of the packaging (100), the space available within the packaging (100), the thickness of the insulative wall (105), among other criteria.

Figure 2:
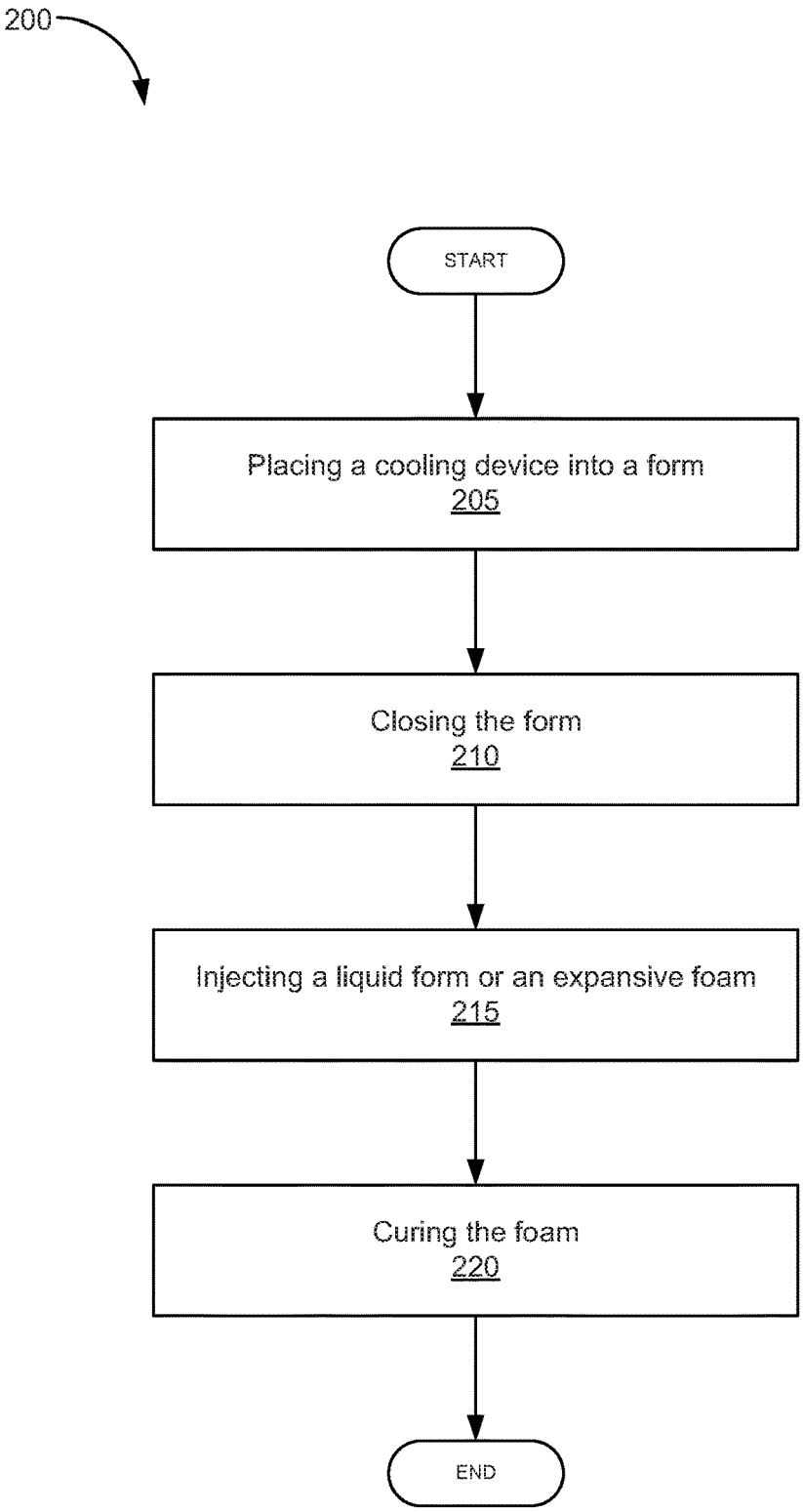
FIG. 2 is a flowchart showing a method of forming at least one insulative wall of a packaging according to an example of the principles described herein.

FIG. 2 is a flowchart showing a method (200) of forming at least one insulative wall (105) of a packaging (100) according to an example of the principles described herein. The method (200) may begin with placing (205) a cooling device (110) into a form. In an example the form may be sized such that an insulative wall (105) is formed around the cooling device (110) (or, alternatively, a heating device) after the form is closed (210). In an example, a heating or cooking device may also be placed in the form in place of the cooling device (110). In these examples, the heat from the heating or cooking device may maintain or increase the heat of any object placed within the packaging.

As described herein, a liquid form of expansive foam may be injected (315) into the form. In an example, the form may include a number of liquid foam inlets into which a type of liquid foam may be passed. In an example, the liquid foam may be a mixture of a polyether polyol resin and a polymeric isocyanate. The placement of the cooling device(s) (110) into the form may depend on the intended cooling (or heating) characteristics within the packaging (100). In an example, the cooling device (110) may be placed (205) such that the cooling device (110) is placed generally center to each of the insulative walls (105) as the curing (220) of the foam. Other placement options are possible and the present specification contemplates those other placements of the cooling device (110) within the form.

The method (200) may further include injecting (215) the liquid form of an expansion foam into the form. As the form is closed, the foam is allowed to cure (220). The method (200) may further include placing a plastic wrap on the interior surfaces of the form prior to placing (205) the cooling device in the form and prior to injecting (215) the liquid form of expansion foam into the form. Placing plastic wrap on the interior surfaces of the form may be done so as to allow the cured (220) foam to release from the interior surfaces of the form. Additionally, the plastic wrap may be used as an exterior layer to the cured foam members created via the method (200). After the foam is cured, the plastic and foam may be trimmed to a desired shape. Trimming may be accomplished using any type of cutting tool including razor blades. In an example, the thickness of the plastic wrap is between 2 and 5 thousandths of an inch. In an example, the thickness of the plastic wrap is 4 thousandths of an inch.

In an example, the insulative walls (105) may be formed either individually or together based on the forms used during the method (200) described herein. In an example, three walls (105) may be formed in form at a time. In this example, the insulative walls (105) placed within the box may include two panels consisting of three walls (105) a piece. The total of six walls (105) forming the cuboid shape within the box may then be arranged to surround a shipped product within the cardboard box.

In an example, a plastic sheeting may be added around all finished sides of the cuboid shape. In this example, the plastic may be made of a high-density polyethylene (HDPE) having a thickness of between 0.010 thousandths of an inch and 0.050 thousandths of an inch. In an example, the sheet of HDPE is 0.030 millimeters thick.

The form may be any form that creates the insulative wall (105) as described herein. In an example, the form may include a number of chamfered ends such that the completed insulative walls (105) include at least one chamfered edge. In an example, the angle of the chamfered edge is 47 degrees relative to a surface of the insulative wall (105). This allows a snug fit between panels of the insulative walls (105) during packaging in order to assure a tight fit between seams.

The method (200) may further include placing the fabricated insulating walls into a freezer. The freezer will freeze the contents of the cooling devices (110) embedded into the insulative walls (105) in preparation for use in packaging of objects and shipment. Any level of freezing or cooling of the cooling devices (110) may be achieved based on a number of factors including what is being shipped using the packaging (100), what temperature the object is to be maintained at, how the long the packaging (100) is to be in transit, among other factors.

Figure 3:
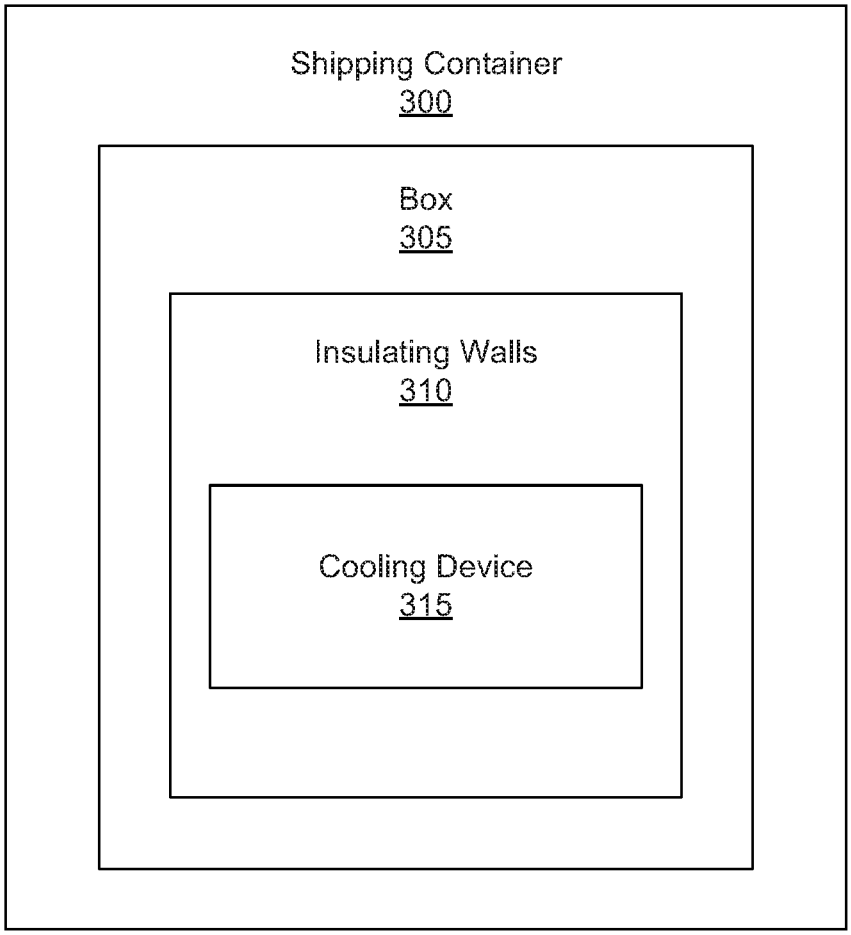
FIG. 3 is a block diagram of a shipping container according to an example of the principles described herein.

FIG. 3 is a block diagram of a shipping container (300) according to an example of the principles described herein. The shipping container (300) may include a box (305), a plurality of insulating walls (310), and, at least one, cooling device (315).

The box (305) may be any type of box that can hold an assembly of the plurality of insulating walls (310) together as described herein. In an example, the box (305) may be made of cardboard similar to those used in the package delivery services. This box (305) may also impart a level of insulation to the insulating walls (310) in order to prevent the transfer of heat into and/or out of the shipping container (300). In an example, the box (305) may also impart a level of rigidity to the assembly of insulating walls (310) as described herein. In an example, the box (305) may be made of corrugated cardboard having a c-flute interior having and edge crush test of 32 or greater.

The insulating walls (310) may be similar to those insulative walls (FIG. 1, 105) described in connection with FIG. 1. The insulating walls (310) may be any type of wall that may help to insulate a product from changes in temperature. In an example, each of the insulating walls (310) may be between 1.5-3 inches at its thickets point. The insulating walls (310) may have an R-value of 5.

The plurality of insulating walls (310) may be formed so as to each be a wall of a cube. The formed cube includes a cubic-void therein formed by the insulating walls (310) such that an object may be placed therein. The object may include any type of object that may be protected from changes in temperature as the shipping container (300) is shipped from its originating location to its destination. This is true for either objects that are to be held at a relatively high temperature compared to the temperature exterior to the box (305) or objects that are to be held at a relatively low temperature compared to the temperature exterior to the box (305).

As described herein, the insulating walls (310) may each have a chamfer formed at least one edge of the insulating walls (310). In an example, the angle of the chamfer may be between 40 and 55 degrees relative to a planar surface of the insulating walls (310) that butts against the box (305) as described herein. In an example, the angle of the chamfer may be 47 degrees relative to a planar surface of the insulating walls (310) that butts against the box (305) as described herein. In an example, each of the edges of each of the insulating walls (310) may have an angle of 47 degrees. By setting the angle to this specific degree, the temperature within the cube formed by the insulating walls (310) may be maintained better relative to other angles. In an example, a lid may be formed out of one of the insulating walls (310) to provide access to a user into the center of the insulating walls (310). This lid may have a thickness of between 1 to 3 inches. In an example, the thickness of all insulating walls is between 1 to 3 inches. In an example, the thickness of the lid may be 1.5 inches. In an example, the thickness of all insulating walls is 1.5 inches.

The cooling device (315) may be any type of cooling device that can help to maintain a temperature level and/or a range of temperatures within the box (305) during transit. As described herein, alternatively a heating device may be used to help maintain a temperature within the box (305). For ease of explanation, however, the present example will be described in connection with implementing a cooling device (315).

The cooling device (315) may be any type of cooling device. In an example, the cooling device (315) may include a bag with the bag full of a crystal polymer and liquid such as water. In this example, 2-3 grams of the crystal polymer may be added to 26-30 ounces of water. As described herein, the cooling device (315) may be formed into at least one of the insulating walls (310). This may be done by placing the cooling device (315) into a form. The form may have an interior sufficient to allow an expansion foam to be introduced and form the insulating walls (310). As the expansion foam expands within the form, the cooling device (315) is embedded into the formed insulating walls (310).

Figure 4:
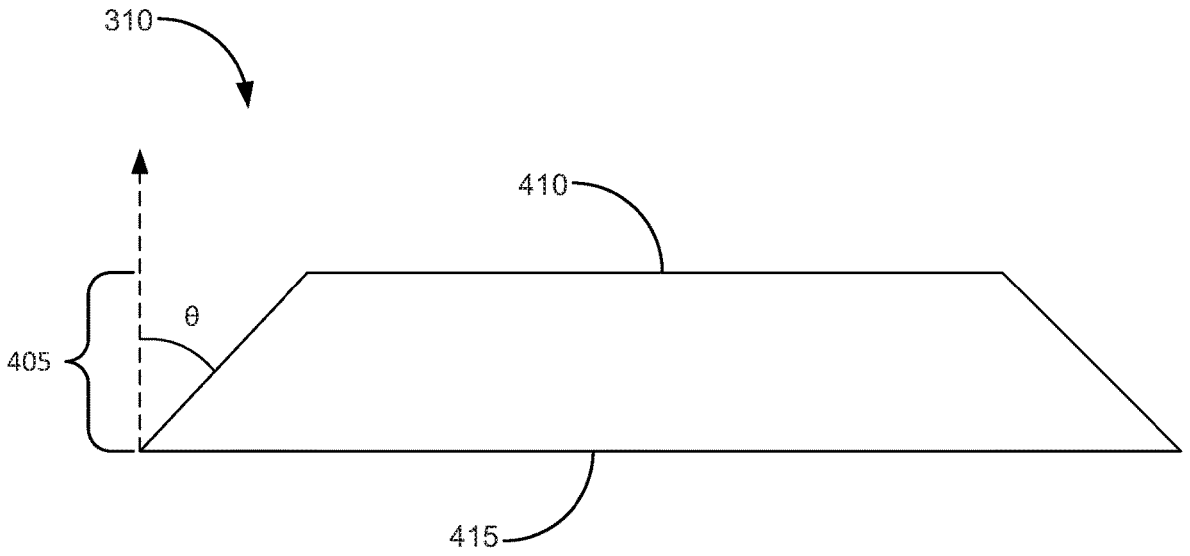
FIG. 4 is a side cut-away view of an insulating walls according to an example of the principles described herein.

FIG. 4 is a side cut-away view of an insulating walls (310) according to an example of the principles described herein. Although FIG. 4 shows a single insulating wall (310), the present specification contemplates the use of a plurality of insulating walls (310) and in some examples, insulating walls (310) that are coupled together at the chamfered edges (405). In this example, a hinge may be formed at the terminal ends of the chamfered edges (405).

The insulating walls (310) may have a first side (410) and a second side (415). The first side (410) forms part of an interior wall within the box (305). Having six interior walls formed by six insulating walls (310), for example, creates a void within the six insulating walls (310) allowing for the placement of the object or product as described herein. The second side (415) is to abut an interior surface of at least one side of the box (305) as described herein. Thus, with six insulating walls (310), the six insulating walls (310) form a cube or other type of polyhedron having six sides that may fit into the box (305).

FIG. 4 also indicates that the chamfer (405) at the edge of the insulating wall (310). The chamfer (405) may have an angle (θ). The angle (θ) may be of any angle relative to the second side (415) and/or the first side (410). As described herein, the angle (θ) may be 47 degrees relative to the second side (415).

Figure 5:
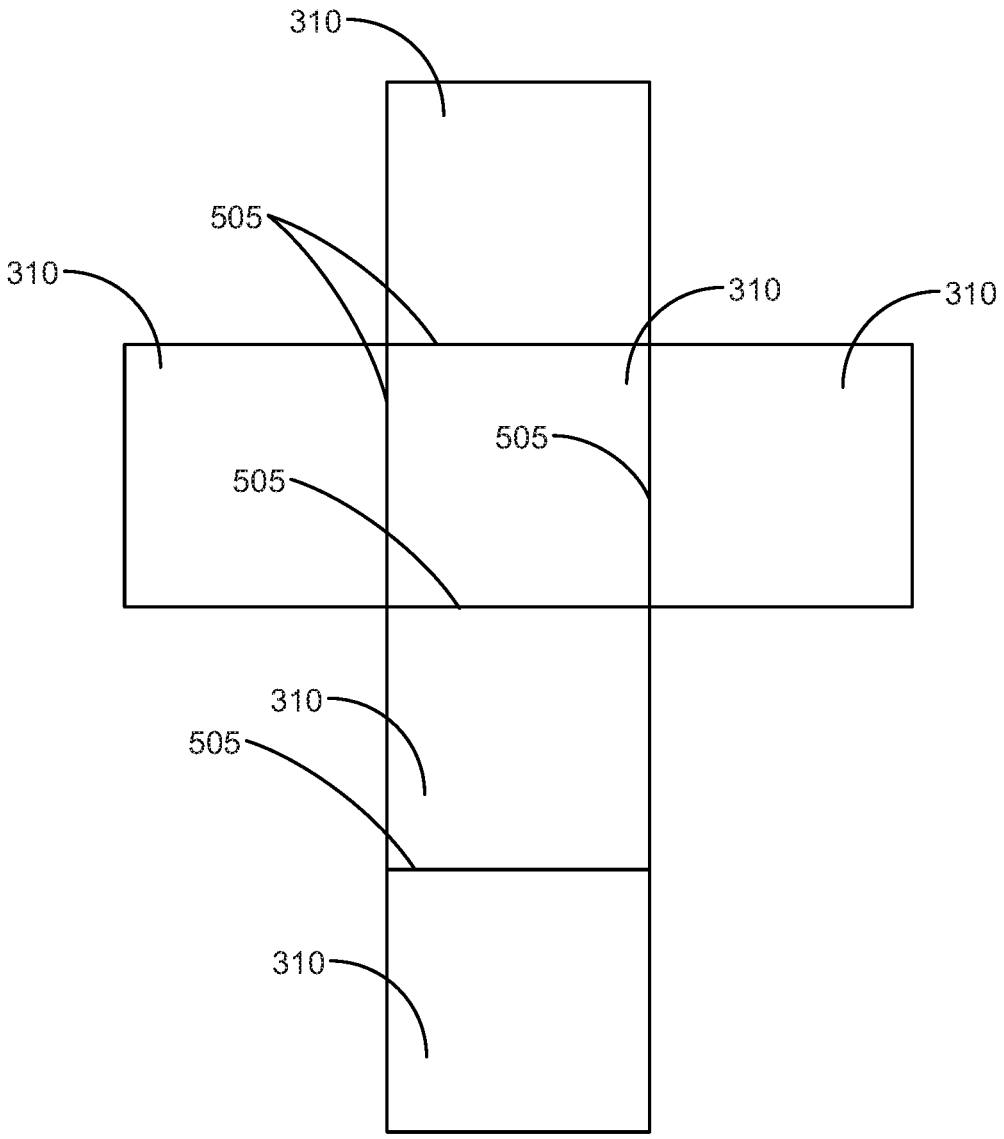
FIG. 5 is a plan view of a plurality of insulating walls according to an example of the principles described herein.

FIG. 5 is a plan view of a plurality of insulating walls (310) according to an example of the principles described herein. In this example, the insulating walls (310) may each be coupled together at their edges via a hinge (505) as described herein. In this example, the hinges (505) allow each of the insulating walls (310) to be connected while being formed into a cube or, generally, a six-sided polyhedron if the dimensions of the insulating walls (310) are not square.

In the example shown in FIG. 5, the insulating walls (310) may be bent at the hinges (505) in order to form the interior void to house the object or product described herein. The insulating walls (310) thus formed, may then be placed within a box (305) such as a cardboard box. In this example, the interior surfaces of the box (305) may abut the exterior surfaces of the insulating walls (310) or the second sides (FIG. 4, 415) of each of the insulating walls (310). In this manner, a shippable container may be produced that allows a perishable product to be transported without being subjected to changes in temperature. As such, products such as frozen goods, chocolates, among others may be shipped without being destroyed by, for example, the temperature outside of the shipping container (300) and/or box (305).

Although FIG. 5 shows all six insulating walls (310) being coupled together using a hinge (505), this is meant as an example only. Indeed, the present specification contemplates that any number of insulating walls (310) may or may not be coupled together in any form. In an example, the six insulating walls (310) may be coupled together to form two different pieces such that the two pieces can be formed together to create the polyhedron as described herein.

Figure 6:
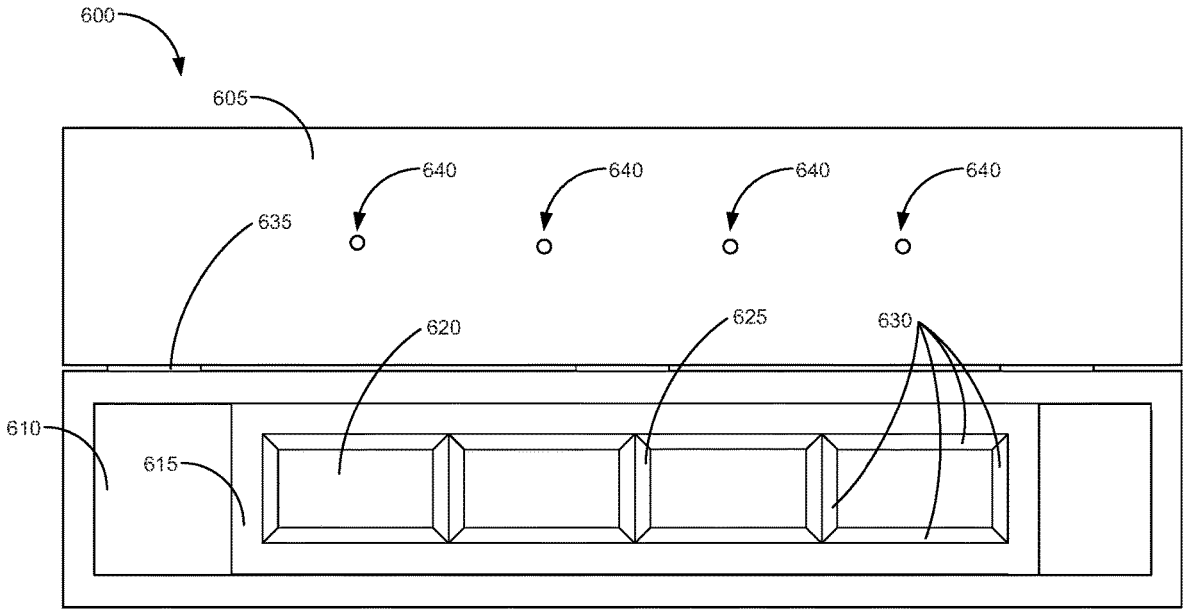
FIG. 6 is a top view of an open form used to form the insulating walls according to an example of the principles described herein.

FIG. 6 is a top view of an open form (600) used to form the insulating walls according to an example of the principles described herein. The form (600) may include a lid (605) and a form base (610).

The lid (605) may have a flat interior surface that interfaces with the form base (610) when in a closed state. This flat interior surface may interface with the form base (610) in order to form the second side (FIG. 4, 415) of the insulating walls (310) as described herein.

In an example, the lid (605) may further include a number of liquid expansion foam holes (640) into which a user may introduce the liquid expansion foam as described herein. The liquid expansion foam may cure as it is pumped into the closed form (600). The lid (605) may also include a number of hinges (635) that allow the form (600).

The form base (610) may include a number of wells (620) defined by a number of walls (615). The walls (615) may each have a chamfer wall (630) next to it. The chamfer walls (630) create the chamfer (FIG. 4, 405) of the insulating walls (FIG. 3, 310) described herein. Although the form (600) shows that each wall (615) includes a chamfer wall (630), it can be appreciated that any number of chamfer walls (630) can dis-include a chamfer wall (630). The form base (610) may also include a number of ribs (625) that also help to form the chamfer (FIG. 4, 405) of the insulating walls (FIG. 3, 310). In an example, some or all of the ribs (625) may extend as tall as the walls (615) and therefore interface with the lid (605) when the form (600) is closed. In this example, no space is provided between a tallest portion of the ribs (625) and the lid (605) thereby preventing the hinges (FIG. 5, 505) between the insulating walls (FIG. 3, 310) described here from being formed. In an example, some space is provided between a tallest portion of the ribs (625) and the lid (605) thereby creating the hinges (FIG. 5, 505) between the insulating walls (FIG. 3, 310) described herein.

In an example, a plastic sheeting may be laid on top of the surface the includes, at least, the wells (620), walls (615), and ribs (625). In this example, a second sheet of plastic may be laid on the bottom side of the lid (605) that interfaces with the form base (610) and may include holes that match the liquid expansion foam holes (640). During use, the two plastic sheets may prevent the liquid expansion foam, when injected, from sticking to the surfaces of the form (600).

Figure 7:
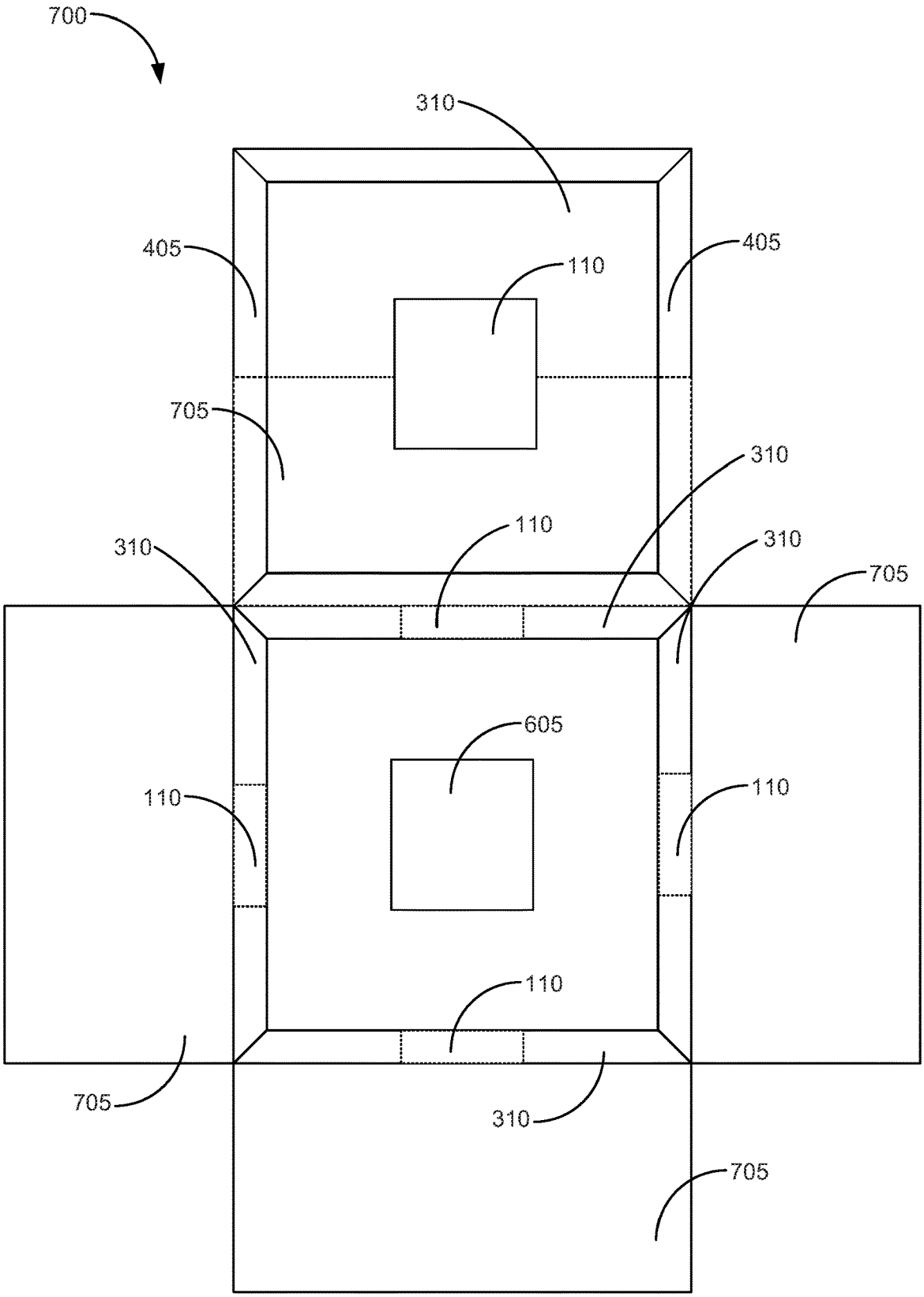
FIG. 7 is a top plan view of the packaging of FIG. 1 according to an example of the principles described herein.

FIG. 7 is a top plan view of the packaging (700) of FIG. 1 according to an example of the principles described herein. The packaging (700) may include, in this example, six insulating walls (FIG. 3, 310), and a box (FIG. 3, 305) to hold the six insulating walls (FIG. 3, 310) therein. In this example, each of the insulating walls (FIG. 3, 310) includes a cooling device (110) as described herein. Although FIG. 7 shows a packaging (700) having six insulating walls (FIG. 3, 310) with each insulating wall (FIG. 3, 310) having a cooling device (110), the present specification contemplates the use of more or less insulating walls (FIG. 3, 310) with any number of the insulating walls (FIG. 3, 310) having a cooing device (110) embedded therein. Additionally, more than six insulating walls (FIG. 3, 310) may be included that fit within the void defined by the insulating walls (FIG. 3, 310) shown in FIG. 7 such that different objects placed within the void in preparation for transit may be separated and further insulated between each other.

The packaging (700) further includes a box (FIG. 3, 305) as described herein. The box (FIG. 3, 305) may provide stability to the insulating walls (FIG. 3, 310) held therein as well as provide additional insulation to the insulating walls (FIG. 3, 310). The box (FIG. 3, 305) may include a number of flaps (705). The flaps (705) may be used to close up the packaging (700) after a top insulating wall (FIG. 3, 310) is closed.

FIG. 7 shows each of the cooling devices (110) as being embedded generally in a central location within each of the insulating walls (FIG. 3, 310). However, the present specification contemplates the embedding of the cooling devices (110) within any portion of the insulating walls (FIG. 3, 310) so as to achieve any localized cooling (or heating) effects on the object as it is placed in the void.

The specification and figures describe a packaging that includes a number of insulative walls having a cooling device embedded therein. The packaging provides for the transport of any object including perishable objects that may be susceptible to changes in temperatures. The packing having the cooling devices embedded therein allows for the void created by the insulative walls to be used solely for the provision of placing objects therein.

The preceding description has been presented to illustrate and describe examples of the principles described. This description is not intended to be exhaustive or to limit these principles to any precise form disclosed. Many modifications and variations are possible in light of the above teaching.

What is claimed is:

1. A packaging comprising:

six insulative wall sections, each of the six insulative walls mechanically coupled to at least one other insulative wall by a hinge to allow the six insulative walls to selectively be laid flat for storage and formed into a packaging container for shipping; and at least one cooling device embedded into the at least one wall, the cooling device and at least one insulative wall forming a monolithic piece.

2. The packaging of claim 1, wherein the six insulative walls together form a cube having a hollow portion therein.

3. The packaging of claim 2, further comprising a cardboard layer exterior to the six insulative walls.

4. The packaging of claim 1, wherein the at least one cooling device includes a plurality of cooling devices embedded into a plurality of the six insulative walls.

5. The packaging of claim 4, wherein each of the plurality of cooling devices embedded into the plurality of the six insulative walls and the plurality of the six insulative walls form a cube having a hollow portion therein to hold an object therein.

6. The packaging of claim 5, wherein the cube comprises a cardboard exterior.

7. The packaging of claim 1, wherein the at least one cooling device is embedded into the at least one of the six insulative walls using a form to receive a liquid form of expansion foam.

8. A method of forming at least one insulative wall of a package, comprising:

placing a cooling device into a form, the form including a plurality of wells defined by a number of chamfered walls and ribs to form a plurality of insulative walls of an insulative package and hinges between the plurality of the insulative walls;

closing the form;

injecting a liquid form of an expansive foam; and curing the foam to create the plurality of insulative walls having the cooling device embedded in at least one of the plurality of insulative walls, the cooling device and the at least one of the plurality of insulative walls forming a monolithic piece.

9. The method of claim 8, further comprising lining at least one interface between the form and the expansive foam with a plastic wrap.

10. The method of claim 9, further comprising trimming a portion of the plastic wrap from a portion of the insulative wall.

11. The method of claim 8, wherein the form forms at least two sides of a cube.

12. The method of claim 8, further comprising forming a plurality of walls to form a cube having a hollow portion to hold an object and forming a cardboard box around the plurality of walls.

13. The method of claim 8, wherein at least one edge of a plurality of abutting insulative walls have a 47-degree chamfer.

14. A shipping container, comprising:

a box;

six insulating walls, at least one side of each of the insulating walls laid against the surface of at least one wall of the box, each of the insulating walls comprising:

four chamfered edges;

at least one hinge between one of the four chamfered edges of a first insulating wall and a chamfered edge of a second insulating; and at least one cooling device embedded into at least one of the six insulating walls, the cooling device and at least one of the six insulating walls forming a monolithic piece.

15. The shipping container of claim 14, wherein the six insulating walls forms a cube within the box, the cube comprising an interior cavity to hold an object.

16. The shipping container of claim 14, wherein an interface between each of the six insulating walls includes a 47-degree chamfer.

17. The shipping container of claim 16, wherein closing of the box causes pressure to be exerted on each of the interfaces between each of the six insulating walls creating a forced fit between each of the six insulating walls.

18. The shipping container of claim 14, wherein the box is made of cardboard.

19. The shipping container of claim 14, where each of the six insulating walls is made of a mixture of a polyether polyol resin and a polymeric isocyanate.

20. The shipping container of claim 19, wherein the mixture of the polyether polyol resin and the polymeric isocyanate are formed by pumping the mixture into a form.

21. The shipping container of claim 20, wherein the cooling devices are placed into the form prior to pumping the mixture into the form.

* * * * *